US005332461A

United States Patent [19]

Huesler

[11] Patent Number: 5,332,461

[45] Date of Patent: Jul. 26, 1994

[54] METHOD OF MAKING A SOLID WOOD SPRING BLADE

[75] Inventor: Beat Huesler, Vezely, France

[73] Assignee: Studio Huesler AG, Zug, Switzerland

[21] Appl. No.: 992,328

[22] Filed: Dec. 21, 1992

[30] Foreign Application Priority Data

Dec. 20, 1991 [CH] Switzerland ..... 03808/91
Aug. 24, 1992 [CH] Switzerland ..... 02621/92

[51] Int. Cl.[5] ..... A47C 23/06; B27M 3/00

[52] U.S. Cl. ..... 156/264; 156/252; 156/257; 5/236.1; 267/158

[58] Field of Search ..... 156/264, 252, 290, 257; 5/238, 237, 236.1; 267/142, 131, 133, 158

[56] References Cited

U.S. PATENT DOCUMENTS

| | | | |
|---|---|---|---|
| 2,275,975 | 3/1942 | McGlone | 5/236.1 X |
| 3,969,558 | 7/1976 | Sadashige | 156/264 X |
| 4,274,901 | 6/1981 | Elber | 156/290 X |

FOREIGN PATENT DOCUMENTS

| | | | |
|---|---|---|---|
| 931005 | 7/1955 | Fed. Rep. of Germany | 156/257 |
| 3439276 | 6/1986 | Fed. Rep. of Germany | 5/237 |
| 3814589 | 11/1989 | Fed. Rep. of Germany | 156/257 |
| 286746 | 2/1991 | Fed. Rep. of Germany | 5/237 |
| 2561978 | 10/1985 | France | 5/236.1 |
| 2657512 | 8/1991 | France | 5/236.1 |
| 149153 | 11/1931 | Switzerland | 156/257 |
| 158112 | 1/1933 | Switzerland | 156/257 |
| 193552 | 1/1938 | Switzerland | 156/257 |

*Primary Examiner*—Jeff H. Aftergut
*Attorney, Agent, or Firm*—Walter C. Farley

[57] ABSTRACT

A spring blade made from solid wood layers (11, 12, 13) for seats and beds has a least one and at the most four glue layers or joints (Sa, 8b), which are approximately perpendicular to the lateral surface (5) having the greatest extension and which interconnect the individual solid wood layers. In the individual solid wood layers the annual rings in full- or semi-comb grained cut are inclined to the lateral face.

11 Claims, 5 Drawing Sheets

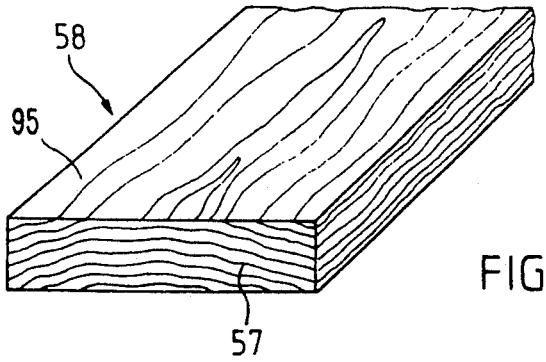
FIG. 6
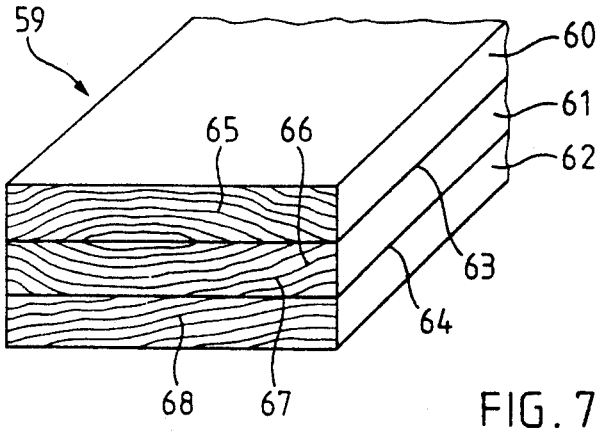
FIG. 7
FIG. 8
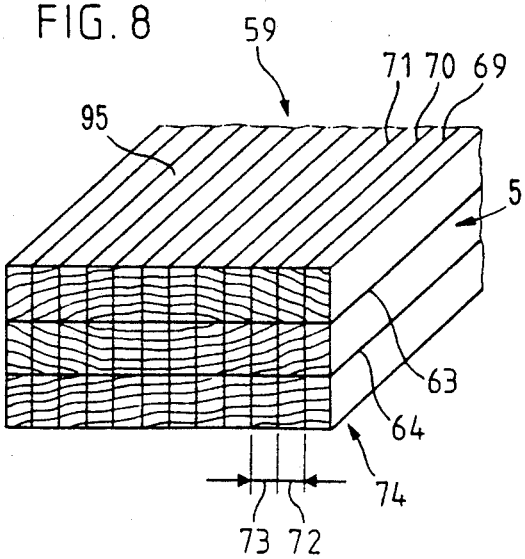
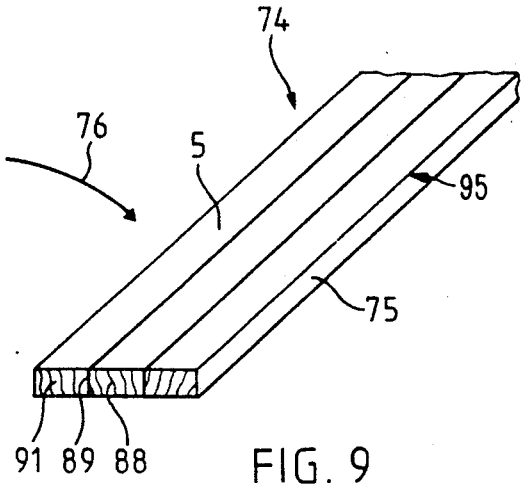
FIG. 9

METHOD OF MAKING A SOLID WOOD SPRING BLADE

FIELD OF THE INVENTION

This invention relates to a wooden spring blade particularly for use in conjunction with a frame as a support for a furniture pad such as a bed mattress.

BACKGROUND OF THE INVENTION

Known wooden spring blades of this type normally have a plurality of laminated wood blades with glue layers running parallel with the blade major surfaces. In this context, the blade is typically relatively flat, having two opposite major surfaces, two opposite side edges and two end faces where the major surfaces are significantly wider than the thickness of the side edges. Such a spring blade is e.g. described in Swiss patent 504 860. As a result of this construction, as well as because of the gluing-in of plastic parts, the resilience and durability of the blade is improved and the danger of breaking of the blades is reduced.

In addition , French patent application 2 582 980 discloses a blade which has a plurality of glue layers running perpendicular to the main blade surface. The origin of these blades is plywood technology and they are also partly produced with glued-in plastics.

Sub-body constructions exist in which the blades, unlike in so-called Flex constructions, have relatively small reciprocal spacing. Horizontally glued or laminated wood and vertically glued blades are unsuitable for such sub-bodies, because they are unable to absorb the condensation moisture formed between the blade and a mattress, which leads to grey areas and mould formation below the mattress. This disadvantage is particularly serious if, as is usually the case, additional plastic decorations are stuck onto the surface of the blade. Thus, in the aforementioned sub-body constructions, solid wood blades are used.

However, these known spring blades suffer from three important disadvantages.

1. They are relatively expensive to manufacture because only absolutely flawless raw material is suitable (particularly in constructions where the blade thickness is below 10 mm). Costs are further increased in that sawn timber with a thickness of over 30 mm, not normally available on the market, is required for the production thereof and, apart from the high cost of the material, losses are additionally increased by rough edge cutting.

2. The second disadvantage is that, after cutting from the rough planks, the blades are often warped in the longitudinal direction by the wood tension released, which increases waste and once again increases costs.

3. As a function of the part of the wood, there are also fluctuations in the blade resilience, which is particularly important in constructions having blades with a thickness below 10 mm and this impairs the quality of the sub-bodies produced.

SUMMARY OF THE INVENTION

An object of the invention is to provide a spring blade and a process for its production which do not suffer from the above disadvantages and which are also simple and inexpensive.

This object is achieved in that, in the manufacture of the spring blades, use is made of solid wood layers or plies having annual rings which run frontally and extend at least zonally approximately tangentially to the lateral faces thereof (tangential cut) having the greatest extension, that at least two and preferably many such solid wood layers are glued together over the lateral faces thereof and that the glued solid wood layers are cut transversely to the annual rings to form spring blades in such a way that the solid wood layers are connected lengthwise with a front semi- or full-comb grained cut.

BRIEF DESCRIPTION OF THE DRAWINGS

The invention, the advantages thereof and the production process are described in greater detail hereinafter with reference to the accompanying drawings wherein:

FIGS. 6, 7 and 8 are partial perspective views of intermediate products in the production process;

FIG. 9 is a perspective view of a spring blade according to the invention;

DESCRIPTION OF THE PREFERRED EMBODIMENTS

Figure 1:
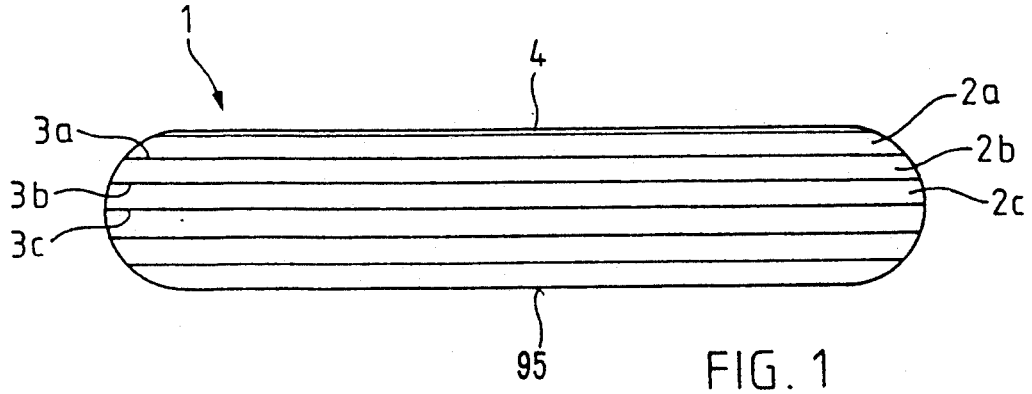
FIG. 1 PRIOR ART
FIGS. 1 and 2 are transverse sectional views through, in each case, a prior art spring blade.

FIG. 1 is a section through a prior art spring blade 1, which comprises solid wood layers or plies 2*a*, 2*b*, 2*c*, etc., which are joined together by glue layers 3*a*, 3*b*, 3*c*, etc., and additionally a decoration 4 is stuck on. The solid wood layers 2 are positioned parallel to a lateral major surface 95, which is the spring blade face having the greatest extension or that which is used for absorbing stresses when the blade is flexed during use. As will be recognized, these blades are intended to be placed on a support structure so that the blades are parallel to each other and so that they span gaps in the support structure, supporting a mattress or other pad.

Figure 2:
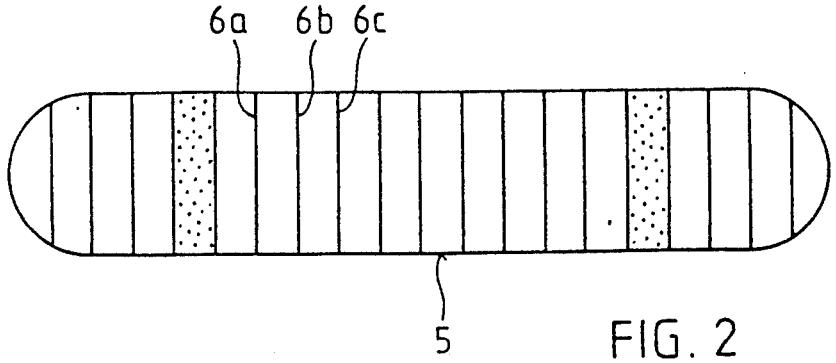
FIG. 2 PRIOR ART

FIG. 2 is a section through a further prior art spring blade with glue layers 6*a*, 6*b*, 6*c*, etc., which are perpendicular to the lateral major surface 5. In this construction, due to the penetration of glue into the pores of the wood in the large number of glue layers, the steam or vapor diffusibility of the spring blade is greatly impeded.

Figure 3:
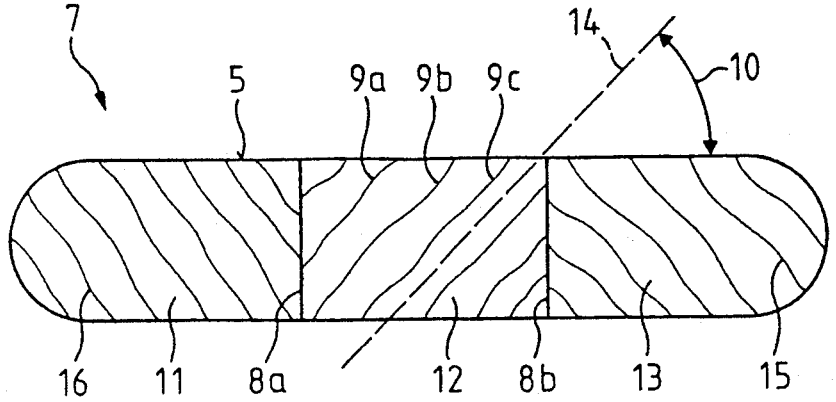
FIG. 3 is a transverse sectional view of a spring blade in accordance with a first embodiment of the invention.

FIG. 3 is a section through a spring blade 7 according to a preferred embodiment of the invention with two vertical glue layers 8*a*, 8*b*, which here interconnect three different sections or solid wood layers 11, 12, 13. In all the solid wood layers are shown annual rings such as occur in the case of full- or semi-comb grained cut, i.e., the annual rings are mainly substantially perpendicular to the direction of the greatest extension of the individual solid wood layers or are generally inclined by up to 45 degrees thereto, the latter then being referred to as semi-comb grained cut. For example, in section 12 annual rings 9a, 9b, 9c, etc., form an angle with the lateral face 5 or with the glue layers 8a, 8b, as is usual for a semicomb grained cut. Preferably, the angle 10 is at least 40 degrees. As a comparison value, an interrupted line 14 is shown which forms an angle 10 with the surface 5. The angle 10 is, e.g., 45 degrees. The same applies with regard to the annual rings 15 and 16 of the sections 13 and 11. Thus, it is clear that the annual rings 9 and 15 of the adjacent sections 12 and 13 do not run parallel to one another and instead move towards or away from one another. This also applies with regard to the annual rings 9 and 16 of the adjacent sections 12 and 11.

The manufacturing process for the spring blades according to FIG. 3 will now be described with reference to FIGS. 4 to 8.

Figure 4:
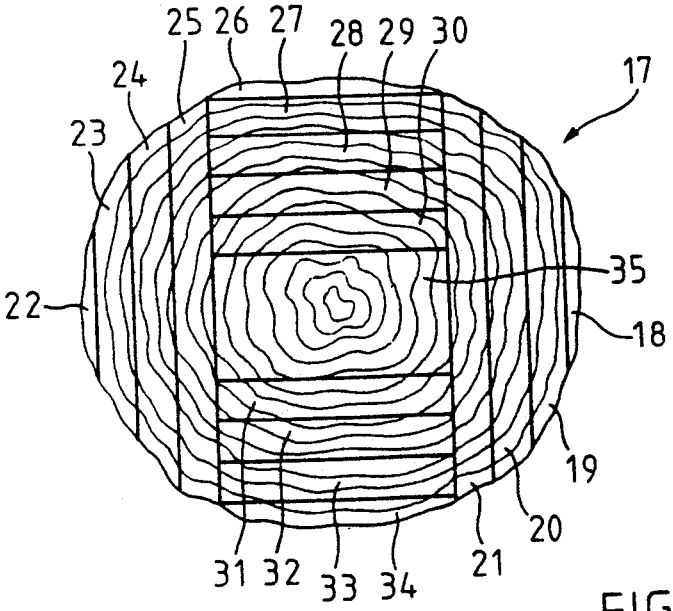
FIGS. 4 and 5 are, in each case, a transverse section through a tree trunk showing lines for cutting the trunk in accordance with the invention.
Figure 5:
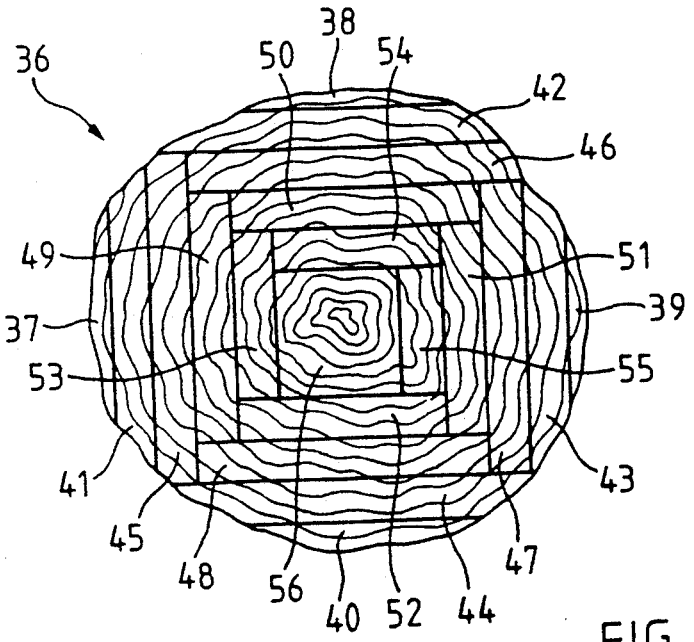

FIGS. 4 and 5 show round timber cutting methods for producing so-called sawn timbers. The round timber or tree trunk 17 is so sawn or cut that planks, plies or layers are obtained in the following way. A first series of parallel cuts gives the layers 18 to 25. A second series of parallel cuts, which are roughly perpendicular to the cuts of the first series, give layers 26 to 34. What is left is a core 35. During cutting or sawing in the manner shown in FIG. 5, after each cut the round timber 36 is turned by 90 degrees. Thus, successively, e.g., layers 37 to 55 are obtained in numerical order and a core 56 is left behind.

This leads to planks or layers which can be as shown in FIG. 6. These planks or layers are tangentially cut and are referred to as sawn timber. It is typically possible to see an annual ring 57. The major surface 95 corresponding to that of FIG. 1 lies roughly tangentially to the annual ring 57. At least two such layers 58 are subsequently glued which forms a blank or unfinished article 59 as shown in FIG. 7. The latter comprises three layers 60, 61 and 62, which are joined by glue layers 63 and 64. The individual layers or plies are preferably so joined that the annual rings are directed in concave and/or convex manner to one another. This is representative for most of the annual rings, namely rings 65, 66 which are concavely related, as well as 67, 68 which are convex. The blank 59 is therefore formed from tangentially cut planks.

FIG. 8 shows a further step in the manufacturing process performed on the blank 59. By cuts 69, 70, 71, etc., made at intervals 72, 73 and preferably performed with a so-called frame saw, spring blades 74 according to the invention are obtained, one being shown in FIG. 9. Cuts 69 and 70 are made approximately perpendicular to the glue layers or bonds 63, 64 in the blank 59.

The spring blade shown in FIG. 9 is obtained by rotating the severed blade in the direction of the arrow 76 and is ready for use. The lateral major surfaces 5 thereof are then as obtained from the sawing process. However, it is also possible to plane or smooth surfaces 5 and the small edge surfaces 75 can be rounded, so that a spring blade like that shown in FIG. 3 is obtained. Such spring blades preferably have a thickness of 4 to 12 mm and a width of 20 to 40 mm. FIG. 9 shows that the annual rings 88 in the end face 91 run roughly as in a comb grained or radial cut.

Figure 10:
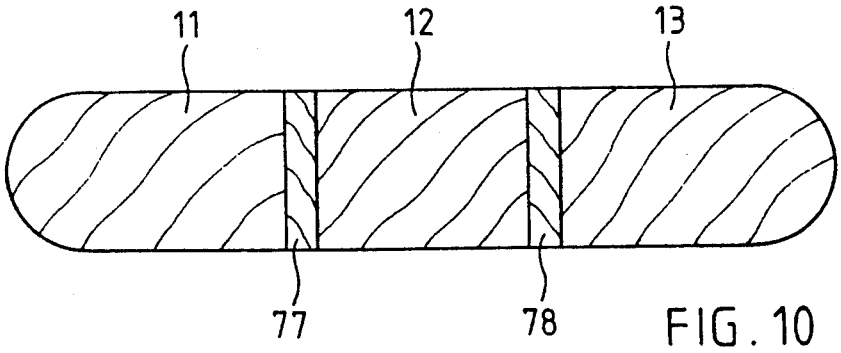
FIG. 10 is an end elevation of another spring blade structure in accordance with the invention.

Further embodiments of the invention will now be described, which have further advantageous characteristics. In order to be able to use biological glue, such as, e.g., casein, without disadvantage for glue layers 8a, 8b (FIG. 3), it is advantageous to provide layers 77, 78 of a further material between the sections 11, 12 and 13, as shown in FIG. 10. These layers 77, 78, which can comprise, e.g., veneer, textile inserts, plaited or woven material, or further unspecified materials, have the function of absorbing the biological glue rapidly, as compared with the absorption speed in a hard wood when it is applied to the wood surface, allowing the glue to be gradually, relatively slowly and over a long period of time supplied to the adjacent wood. Thus, the glue passes into the wood of the sections 11, 12 and 13 of the spring blade at a speed at which the wood is able to absorb it. These layers from the further material consequently act as a temporary glue reservoir.

Figure 11:
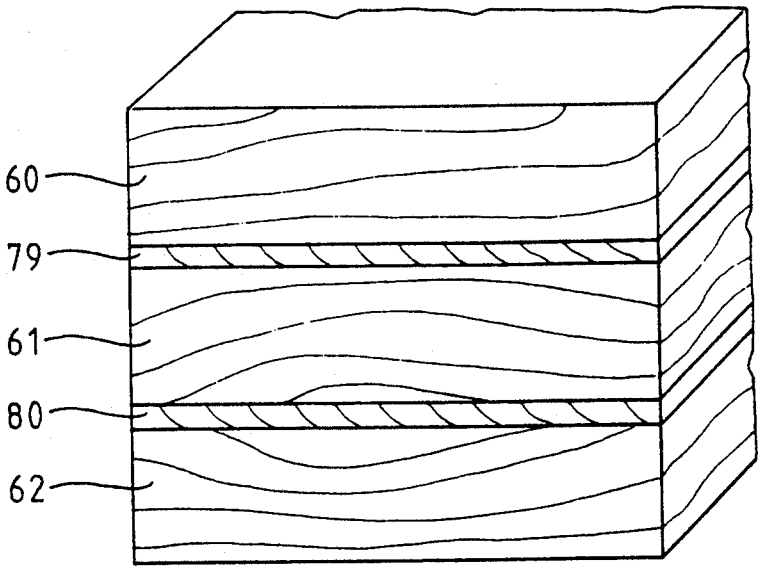
FIG. 11 is a perspective view of a further intermediate product.

These glue-absorbent layers from further material preferably have a thickness of 0.5 to 4 mm and should especially be used if the wood for the spring blades is a so-called hard wood such as ash or maple, so as to produce spring blades with high bearing strength. If these layers are made from veneer, then they are preferably produced from rotary-cut veneer and consequently form a uniform layer, which in the trunk runs roughly parallel to the annual rings. The layers are preferably integrated into the glue layers 62, 63 in accordance with the described process and this also occurs in the blank 59 as shown in FIG. 7. This can also be gathered from FIG. 11, in which such layers are made from a further material, e.g., in the form of soft wood layers 79, 80 positioned between layers 60, 61, 62.

Figure 12:
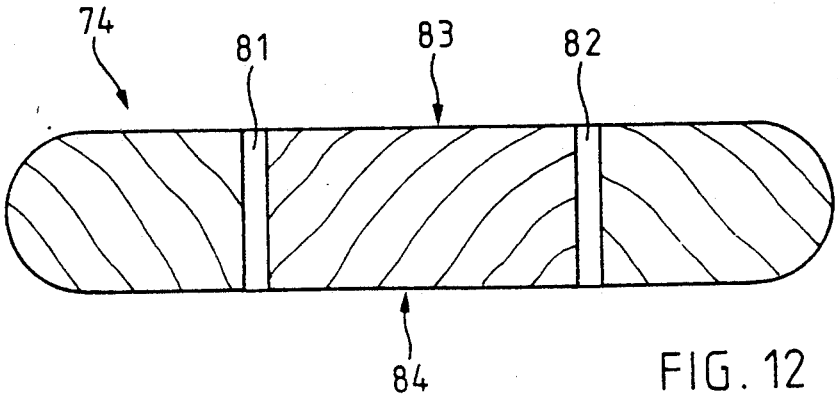
FIGS. 12 to 14 are end elevation, plan and perspective views of, in each case, further embodiments of spring blade structures in accordance with the invention.
Figure 14:
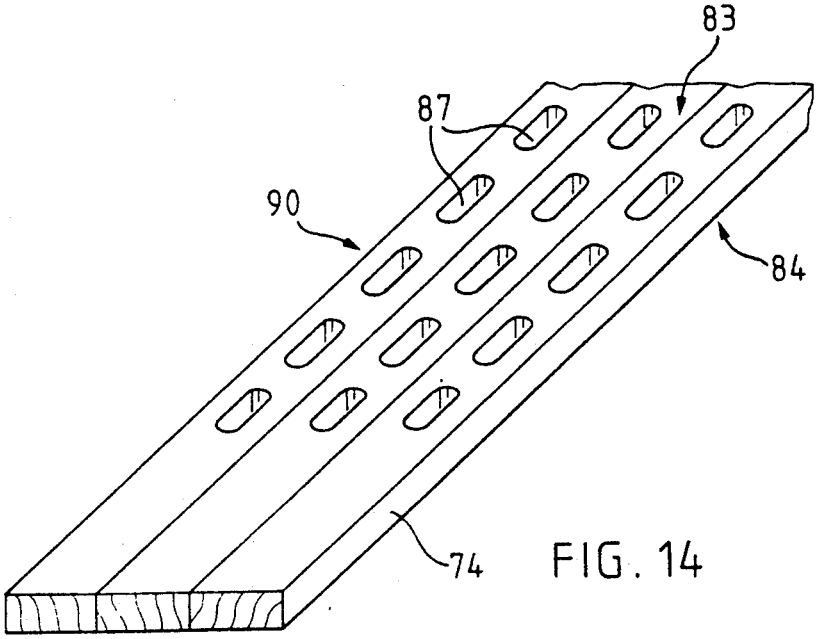

In order to make the spring blades 74 according to the invention as permeable as possible to condensation moisture, it is also possible to make therein bores, holes or slits. Examples of such slits 87 are shown in FIG. 14 where they are positioned in the spring blades 74 in such a way that they join a bearing surface 83 for supporting a mattress with a free underside 84 and in this way offer a path to the outside for the moisture passing out of the mattress. However, in order not to reduce the strength or bearing strength of such spring blades, preferably such slits 87 or bores 81, 82, as shown in FIG. 12, are provided in the layers made from the further material and this is particularly advantageous in the case of soft wood layers.

Figure 13:
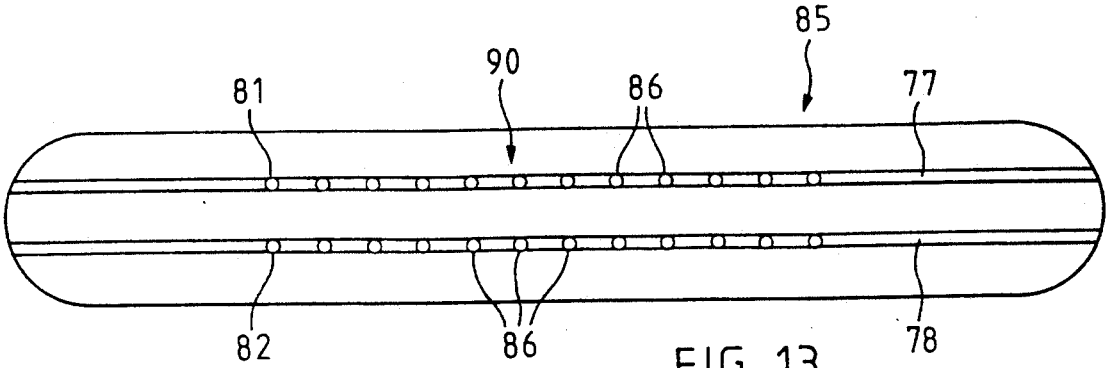

Bores, slits, etc., should in particular be provided in the central part 90 of the blades, as shown in FIGS. 13 and 14. In said central part is normally positioned the body of a sleeping person and correspondingly in said area it is necessary to remove most of the moisture which occurs.

FIG. 13 shows a spring blade according to the invention with soft wood layers 77, 78 and bores 81, 82, 86 therein, in plan view. As said bores are made in the finished blade, e.g., by punching, their diameters can be both smaller and larger than the thickness of the layers 77, 78. In the latter case the bores can also penetrate the hard wood of the spring blade.

The spring blades produced in this way have in particular the following advantages.

1. The breathability (steam or vapor diffusibility) of the blade is fully maintained, unlike in the case of conventionally glued blades.

2. As a result of the cutting of thin sawn timber, the rough edge cutting can be reduced and the wood drying costs decreased. The sawn timber or raw material can be obtained in a thickness which is inexpensively available as a standard product.

3. As a result of the preferably three-part blade, small wood faults (non-parallel annual rings, knots) are bridged and consequently waste is further reduced.

4. The glued layer leads to compensation of the wood tension following splitting (FIG. 8) from the blank such that waste as a result of warped blades is considerably reduced.

5. This construction also minimizes resilience differences and consequently leads to a more balanced quality end product.

6. The annual ring configuration of at least 40 degrees, based on the blade surface, leads to an improvement in the blade resilience, also leads to a reduction of dishing of the blade surface, as well as to an improvement in blade breathability (steam or vapor diffusibility).

I claim:

1. A process for producing spring blades comprising the steps of forming a plurality of solid wood layers (58) each having annual rings (57) which extend in a frontal direction and approximately tangentially to major surfaces (95) of said layers, gluing the plurality of solid wood layers (60, 61, 62) together with the major surfaces of adjacent solid wood layers parallel and facing each other, and cutting the glued solid wood layers (60, 61, 62) transversely to the annual rings and perpendicular to the major surfaces of the solid wood layers to form spring blades (71) having solid wood layers of a thickness of 4 mm to 12 mm and wherein the annual rings are substantially perpendicular to the cut surfaces.

2. A process according to claim 1 wherein the step of cutting includes sawing the glued solid wood layers directly with a frame saw to form the spring blades without subsequent planning.

3. A process according to claim 1 and including cutting the glued solid wood layers at intervals of between 4 and 12 mm corresponding to a desired spring blade thickness.

4. A process according to claim 1 and including gluing three solid wood layers (60, 61, 62) together.

5. A process according to claim 1 and including forming bores (86) through the spring blades (74) between major surfaces (5) of the spring blades.

6. A process according to claim 1 and including gluing the solid wood layers (60, 61, 61) together with layers (79, 80) made from a material acting as a glue reservoir.

7. A process according to claim 1 wherein the plurality of solid wood layers includes no more than five layers.

8. A process according to claim 1 wherein the width of each cut spring blade is between 20 and 40 mm.

9. A process according to claim 1 wherein the annual rings are inclined relative to opposite major surfaces of the cut spring blades.

10. A process according to claim 1 and including gluing the solid wood layers together with layers of an adhering material between the major surfaces of the solid wood layers, the adhering material having a thickness of between 0.5 and 4 mm.

11. A process according to claim 10 and including forming openings entirely through the adhering material layers.

* * * * *